United States Patent [19]

Bednarczuk

[11] Patent Number: 4,523,760

[45] Date of Patent: Jun. 18, 1985

[54] PORTABLE GOLF DRIVING NET ASSEMBLY

[76] Inventor: Robert Bednarczuk, 2283 Bone Rd., R.R.#4, Lebanon, Ohio 45036

[21] Appl. No.: 539,090

[22] Filed: Oct. 5, 1983

[51] Int. Cl.[3] ..... A63B 69/36

[52] U.S. Cl. ..... 273/181 F; 273/29 B

[58] Field of Search ..... 273/181 F, 26 A, 73 D, 273/29 B, 29 BA, 29 BC, 182 R, 182 A, 181 A, 29 A, 176 B, 176 F, 176 J, 411, 410, 407, 127 R

[56] References Cited

U.S. PATENT DOCUMENTS 2,944,816 7/1960 Dixon ..... 273/181 F X 3,001,795 9/1961 Johnson ..... 273/26 A X

FOREIGN PATENT DOCUMENTS 237130 7/1925 United Kingdom ..... 273/29 B

*Primary Examiner*—George J. Marlo

*Attorney, Agent, or Firm*—Reuben Wolk

[57] ABSTRACT

A portable golf driving net assembly which is simple to assemble and disassemble. The net is formed of a frame and a net is wrapped around the frame and secured thereto by passing separate lacing members through the wrapped portions of the net which overlap the top and side members of the frame, and through the corresponding non-overlapped portions of the net. The net is quickly removed from the frame by removing the lacing members.

7 Claims, 3 Drawing Figures

PORTABLE GOLF DRIVING NET ASSEMBLY

BACKGROUND OF THE INVENTION

Golfers find that practicing their shots inevitably improves the quality of their game. One popular method of practice involves the use of portable nets which can be set up in convenient places, such as back yards, gymnasiums, or basements, so that the golfer can hit golf balls into the net even if he is limited by space to small areas. The ideal golf net should be portable, easy to assemble and disassemble, and be so constructed that the balls will fall harmlessly to the front of the net after striking it, and not bounce dangerously away from the net.

PRIOR ART STATEMENT

While portable nets are known in the prior art, they are usually complex in construction, difficult to assemble, and require hardware such as nuts, bolts, screws, or staples, and appropriate assembly tools such as hammers, wrenches, screwdrivers, and pliers. Further, even the so-called portable devices are not fully capable of being compactly packed to provide convenient storage and transportation. The following prior art is typical of these complex structures: Lee, U.S. Pat No. 3,986,719, Oct. 19, 1976; La Rose, U.S. Pat. No. 4,063,739, Dec. 20, 1977.

The Lee patent sets forth a rectangular frame mounted on a pair of fore-and-aft extending rockers, the net is secured to the frame by a number of retaining clips which are free to slide along the frame which seem designed to permanently secure the net to the frame. The frame can be disassembled at its corners.

The La Rose patent provides for a rectangular frame with a net attached to the frame in an undisclosed manner which would appear to provide for a rigid effect. This is partially due to the fact that the attachment is at all four sides.

SUMMARY OF THE INVENTION

The present invention represents an improvement over the prior art by providing for rapid assembly and disassembly of the net with respect to the frame, thus presenting a novel net assembly.

It is a principal feature of the invention to permit the rapid assembly of the net to the frame by the simple expedient of wrapping the top and side edges of a woven net over the top and side frame members, so that these edges overlap the members. Lacing members are passed alternately through the overlapped edges and the adjacent principal portions of the net to retain the edges in the overlapped positions. Disassembly is accomplished by pulling one end of each lacing member so that the overlapped edges are free, allowing the net falls from the frame of its own weight. Thus no further action is required to remove the net. By use of the lacing members, no clips are required, such as shown in the Lee patent, nor any other hardware.

It is a further feature of the invention to secure the net to the frame without the use of tools, such as pliers which Lee might be forced to use in attaching his clips.

An additional feature resides in the fact that the net is not permanently secured to the frame, as in La Rose, but is a separate fabric member that can easily be rolled, folded, or hung on hooks for storage.

It is an additional feature of this invention to make the net somewhat larger than the frame, so that when it is assembled it is not taut, but hangs rather loosely from the frame. Some of the net even lies loosely on the ground in front of the frame. This means that when balls are driven into the net, the energy imported to the balls is absorbed by the looseness of the net, so that the balls will fall harmlessly to the ground, or into the portion of the net on the ground, rather than rebounding in various directions. It should be appreciated that the tautly mounted nets of the prior art create a rigid member because the frame and the net interact in such a manner that they may as well be a rigid board.

A further feature of the invention resides in the manner in which the frame sections may be easily assembled and disassembled, providing a compact package for storage.

Other details, features, and objects of the invention will become apparent from the embodiment presented in the following specification, claims, and drawings.

BRIEF DESCRIPTION OF THE DRAWING

The accompanying drawing shows the preferred embodiment of the invention, in which.

DESCRIPTION OF THE ILLUSTRATED EMBODIMENT

Figure 1:
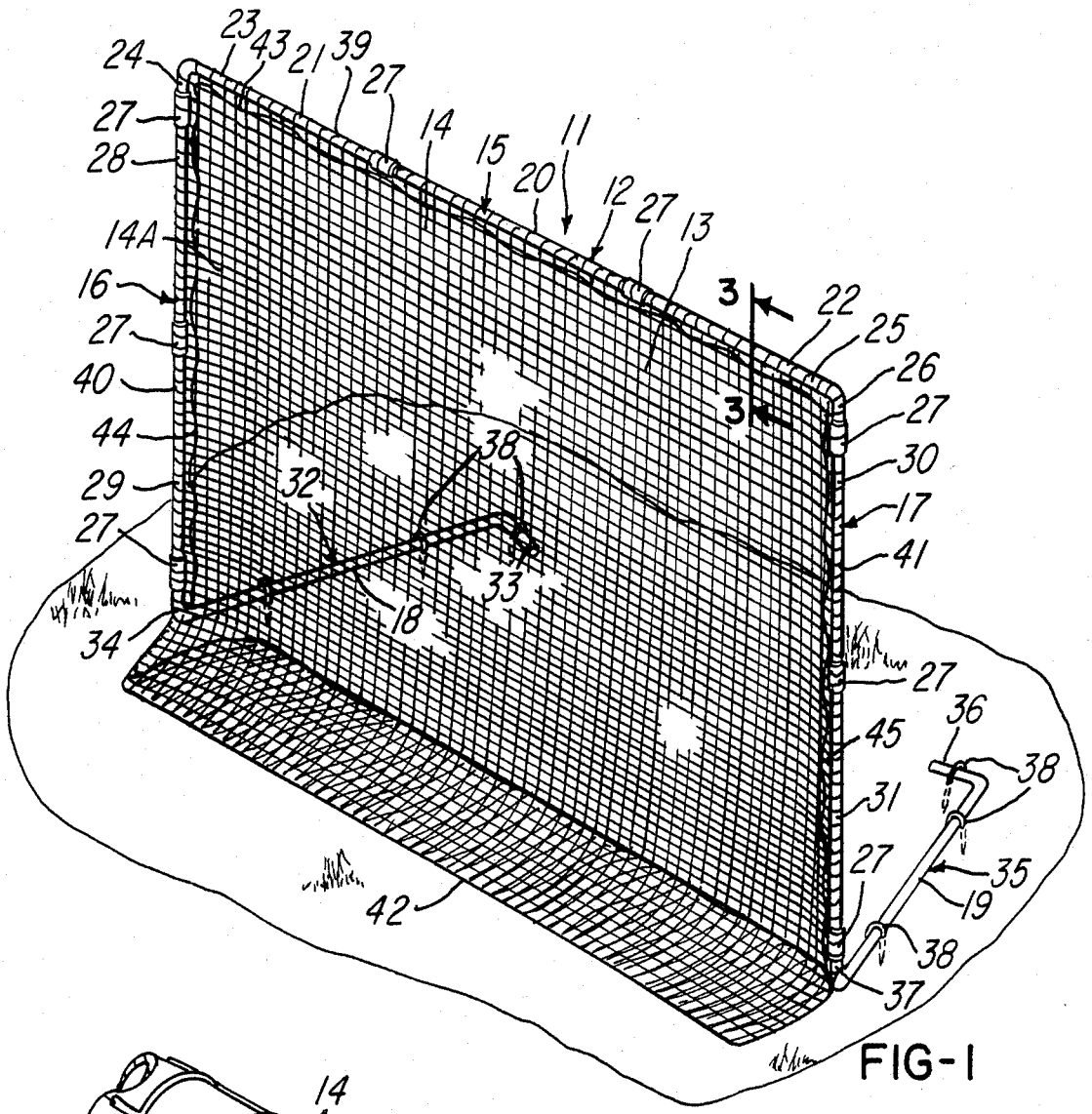
FIG. 1 is a perspective view of the novel net assembly, with parts broken away to illustrate portions of the frame support.

Referring now to FIG. 1, the novel net assembly 11 is illustrated, comprising a frame 12 and a net 13. The net is assembled on the frame in a manner described below. The net 13 is fairly conventional in construction, and may be formed like a fish net with parallel cords extending at right angles to each other, preferably knotted at the intersecting points. The cords may be nylon or ordinary hemp, preferably about 0.030 inches in diameter, and forming a mesh slightly less than one inch. While the exact design of the net is not critical, it should be wear-resistant and it should be heavy enough to absorb the energy of the golf ball that strikes it. These cords are designated by reference numeral 14 for the vertically extending cords and 14A for the horizontally extending cords.

The frame 12 can be made of any rigid material which is suitable, but is preferably formed of sections of aluminum tubing. This construction is light enough to simplify handling, but provides the necessary rigidity. The frame when assembled consists of a top member 15 assembled to two vertical side members 16 and 17, and two supporting members 18 and 19, secured to the side members and adapted to be placed along the ground at an angular position as shown in the drawing. While the frame may be made of various lengths and types of tubing sections, it is desirable to make the sections short and easily interconnectable so that transportation and storage is simplified.

In the example shown, the top member 15 is made up of a straight center section 20 and two end sections 21 and 22. The end section 21 is comprised of a straight segment 23 and terminates in a vertical end segment 26 at right angles thereto. The ends of center section 20 are coupled to the adjacent ends of segments 23 and 25 by means of identical slip couplings 27, which are in the nature of sleeves that slide over the adjacent ends, in a manner well known in the prior art. The left side 16 of the frame is composed of two straight sections 28 and 29, also interconnected by a slip coupling 27, the upper section 28 being interconnected to the vertical segment 24 of section 21 by means of another slip coupling 27. In a similar manner, the right side 17 of the frame is composed of two straight sections 30 and 31, interconnected to each other by another slip coupling 27, the upper section 30 being interconnected to vertical segment 26 of section 22 by another slip coupling 27. The supporting member 18 is formed into a center segment 32, a bent segment 33 at one end, and a vertical extending segment 34 at right angles to the other end. Segment 34 is interconnected to the lower end of section 29 by means of another slip coupling 27, and the segments 32 and 33 are arranged in the same horizontal plane to lie along the ground. In a similar manner, the supporting member 19 is formed into a center segment 35, a bent horizontal end segment 36, and a vertical segment 37 which interconnects with the lower end of section 31.

In assembling the frame 12 just described, the supports 18 and 19 are first placed on the ground in the desired area, so that center segments 32 and 35 and end segments 33 and 36 are flat on the ground. These segments are then secured to the ground by means of staples 38 which members 16 and 17 are next assembled by interconnecting lower sections 29 and 31 with segments 34 and 37 of the supports, then interconnecting upper sections 28 and 30 with the lower sections, all by use of slip connectors 27. The top member 15 is pre-assembled by interconnecting its segments 21, 22 and 23 (using slip connectors). Finally, the vertical segments 24 and 26 are interconnected to the upper sections 28 and 30 with similar slip connectors 27.

Figure 2:
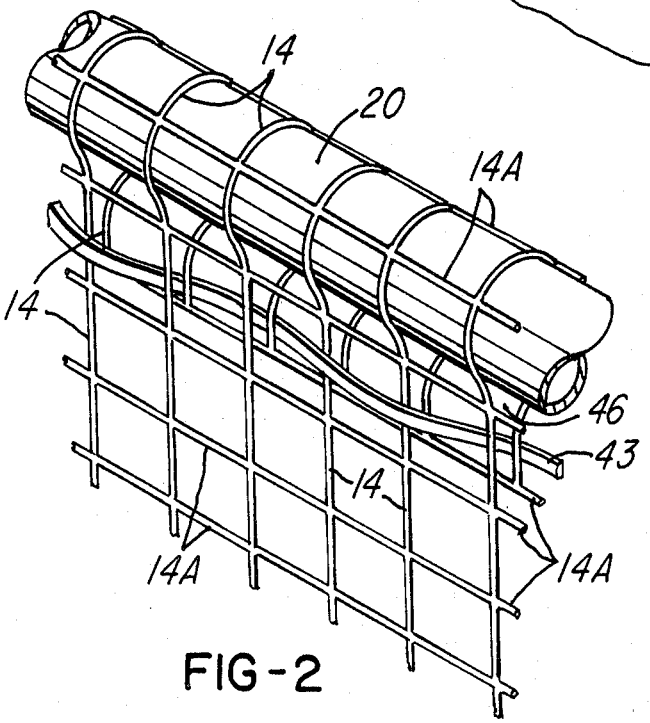
FIG. 2 is an enlarged perspective view of a portion of the net and frame, illustrating in detail the arrangement for securing the net to the frame.

Having completed assembly of the frame 12, the next step is the attachment of the net 13 to the frame; therein resides the principal feature of my invention. As indicated above, the net is slightly longer than the distance from the top member 15 to the ground. The net is placed over the frame so that the upper edge 39 overlaps the top member, the left edge 40 and the right edge 41 overlap the side members 16 and 17, and a few inches of the bottom edge 42 lies along the ground. A lacing member 43, such as a lace or a cord, is then used to secure the top of the net to the top member 15 by passing the lace alternately between the vertically extending cords 14 of the edge 39, and the vertically extending cords 14 of the adjacent part of the net. This is best shown in FIG. 2. The lacing member 43 is preferably made of nylon, but may be made of any other suitable material, and may be rectangular in cross-section if it is a lace, or round in cross-section if it is a cord, and is larger in diameter than the cords which comprise the net. By alternately passing or interlacing the lace 43 behind the top edge 39 and in front of the adjacent face of the net, as shown in FIG. 2, the overlapping edge 39 is thus secured to the principal portion of the net, near the top thereof. The lace may be passed from left to right or right to left. In addition to passing the lace as shown, it may optionally pass through the bights 46 formed by passing the edge over the top frame member. In a hand operation of this type, there need be no specific pattern of lacing—the lace may be passed behind the edge, in front of the net, or through the bight, at the whim of the person assembling the net, completely at random. The concept involved in the operation is simply to hold the edge of the net in place. The lace may have a metal tip similar to a shoelace tip, to aid in the lacing process.

Figure 3:
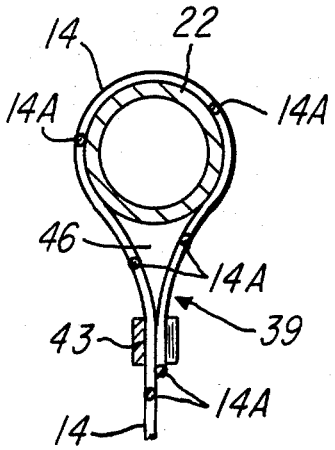
FIG. 3 is a sectional view taken along line 3—3 of FIG. 1.

The exact amount of net material overlapping the top frame member is not critical, but it should overlap sufficiently so that the lace may be above at least one of the horizontally extending cords 14A, as shown in FIGS. 2 and 3, to help hold the lace in position.

After the top lace is passed through, the same procedure is followed for the sides. Separate lacing members 44 and 45, similar to lace 43, are passed alternately behind the horizontally extending cords 14A of the edges 40 and 41, and in front of the cords 14A of the adjacent face of the net. Alternatively, the lacing members may be passed through some of the bights formed similarly to the bights 46. As is the case with the top lacing, the lacing pattern is random. Preferably the laces will be passed from top to bottom.

Because of the pressure of the interlaced portions of the net, ends of the laces need not be tied or knotted, although this may be done if desired. This is also true of top lace 43. The net is now in position for use, and is loosely positioned over the frame, yet securely held, so that the net absorbs the impact of any balls that strike it. The balls will drop to the ground or into the lower portion lying on the ground, where they are easily retrieved for re-use.

The disassembly of the structure is very simply accomplished, due to the simplicity of the fastening system. The lacing members 44 and 45 are pulled out to release the side edges 40 and 41, and then the top lacing member 43 is pulled out to release the top edge 39. The entire net then falls to the ground, where it may be folded into a compact body of about two feet by three feet. The frame is disassembled in reverse order from the assembly, removing the top sections from the side sections, the side sections from the support, and then removing the staples from the ground to release the support. By pulling the various sections apart, they may be placed atop the folded net, the whole to be carried for storage in a box on the trunk of a car, or may be hung on hooks in a garage or basement.

The above described embodiment is exemplary of the invention, and variations are contemplated as being within the scope of the invention.

I claim:

1. A recreational net assembly comprising a frame having a plurality of members, a net, and means for mounting said net on said frame, said net having an arrangement of first and second sets of generally parallel spaced-apart cords, said sets arranged generally perpendicular to each other and having ends which constitute edges of said net, the spaced-apart cords in at least one edge overlapping at least one of said frame members and contacting at least some of the spaced-apart cords constituting an adjacent part of said net, said mounting means comprising a lacing member passed alternately between spaced-apart cords in said one edge and said adjacent part of said net.

2. The assembly of claim 1 wherein said frame includes a top member and two vertically extending side members, said net having a top edge and two side edges respectively overlapping said top member and said side members, said mounting means comprising a plurality of lacing members, each of which is passed alternately between spaced apart cords in one of said edges and an adjacent part of said net.

3. The assembly of claim 2 wherein said frame further comprises a pair of supports interconnected to said side members, said supports adapted to be placed on a flat surface to support said assembly.

4. The assembly of claim 2 wherein said top member and said side members are each comprised of a plurality of removable sections.

5. The assembly of claim 1 wherein said net is wider and longer than said frame, said net being loosely mounted on said frame to absorb impact of balls driven against it.

6. The assembly of claim 1 wherein said net comprises a plurality of vertically extending parallel cords interwoven with a plurality of horizontally extending parallel cords, said lacing member being randomly passed between vertically extending cords in said edge and vertically extending cords in said adjacent part of said net.

7. The assembly of claim 6 further comprising at least one additional lacing member, said additional member being randomly passed between horizontally extending cords in another edge and horizontally extending cords in another adjacent part of said net.

* * * * *